US009269226B2

(12) United States Patent
Johnson et al.

(10) Patent No.: US 9,269,226 B2
(45) Date of Patent: Feb. 23, 2016

(54) WAGERING GAME METHOD, GAMING MACHINE, GAMING SYSTEM, AND PROGRAM PRODUCT PROVIDING LOCAL AND GROUP PROGRESSIVE PRIZES

(71) Applicant: Multimedia Games, Inc., Austin, TX (US)

(72) Inventors: Bradley Johnson, Austin, TX (US); Keith Riggs, Austin, TX (US); Jim McHugh, Austin, TX (US); Clint Owen, Austin, TX (US); Brian Watkins, Austin, TX (US); J P Cody, Austin, TX (US)

( * ) Notice: Subject to any disclaimer, the term of this patent is extended or adjusted under 35 U.S.C. 154(b) by 168 days.

(21) Appl. No.: 13/864,010

(22) Filed: Apr. 16, 2013

(65) Prior Publication Data

US 2013/0274004 A1 Oct. 17, 2013

Related U.S. Application Data

(60) Provisional application No. 61/625,581, filed on Apr. 17, 2012.

(51) Int. Cl.
*G07F 17/32* (2006.01)

(52) U.S. Cl.
CPC ..... *G07F 17/3244* (2013.01); *G07F 17/3258* (2013.01)

(58) Field of Classification Search
None
See application file for complete search history.

(56) References Cited

U.S. PATENT DOCUMENTS

| | | | | |
|---|---|---|---|---|
| 6,626,758 | B1 | 9/2003 | Parham et al. | |
| 7,575,517 | B2 | 8/2009 | Parham et al. | |
| 7,811,168 | B2 | 10/2010 | Parham et al. | |
| 7,871,328 | B2 | 1/2011 | Parham et al. | |
| 7,887,415 | B2 | 2/2011 | Parham et al. | |
| 2006/0277100 | A1 | 12/2006 | Parham | |
| 2009/0111561 | A1 * | 4/2009 | Dewaal et al. | 463/20 |
| 2009/0197674 | A1 | 8/2009 | Parham et al. | |
| 2010/0144417 | A1 * | 6/2010 | Wright et al. | 463/17 |
| 2011/0081963 | A1 * | 4/2011 | Chongolnee | 463/27 |
| 2011/0130186 | A1 * | 6/2011 | Chim | 463/16 |
| 2011/0130196 | A1 | 6/2011 | Parham et al. | |
| 2011/0269521 | A1 * | 11/2011 | Walther et al. | 463/17 |
| 2012/0046098 | A1 * | 2/2012 | Cuddy | 463/27 |
| 2012/0088576 | A1 * | 4/2012 | Shepherd et al. | 463/26 |

* cited by examiner

*Primary Examiner* — Jason Yen
(74) *Attorney, Agent, or Firm* — Russell D. Culbertson, Esq.; JP Cody, Esq.

(57) ABSTRACT

A progressive prize method for a group of linked gaming machines includes maintaining both a respective local progressive pool for each respective gaming machine in the group and a group progressive pool shared among the group of gaming machines. A local progressive prize trigger is used to determine when a progressive prize is to be awarded from a local progressive pool and a separate group progressive trigger is used to determine when a progressive prize is to be awarded from the group progressive pool. The group progressive trigger may be based on a count of local progressive prizes that have been awarded. Thus a local progressive trigger may ultimately result in the award of a progressive prize from the group progressive pool rather than the respective local progressive pool.

14 Claims, 7 Drawing Sheets

WAGERING GAME METHOD, GAMING MACHINE, GAMING SYSTEM, AND PROGRAM PRODUCT PROVIDING LOCAL AND GROUP PROGRESSIVE PRIZES

CROSS-REFERENCE TO RELATED APPLICATION

The Applicants claim the benefit, under 35 U.S.C. §119(e), of U.S. Provisional Patent Application No. 61/625,581 filed Apr. 17, 2012, and entitled "Wagering Game Method, Gaming Machine, Gaming System, and Program Product Providing Local and Group Progressive Prizes." The entire content of this provisional application is incorporated herein by this reference.

TECHNICAL FIELD OF THE INVENTION

This invention relates to wagering games, gaming machines, gaming systems, and associated methods and program products which provide progressive prizes. More particularly, the invention relates to wagering games, gaming machines, and gaming systems which provide multiple types of progressive prizes, some types based on contributions at a single gaming machine and other types based on contributions across a group of linked gaming machines.

BACKGROUND OF THE INVENTION

Numerous types of wagering games have been developed in an attempt to provide players with new and varied gaming experiences. In addition to providing different wagering games with different primary games and various different types of bonus or secondary games, games may offer various types of payout schedules in different wagering games and may vary the payout volatility of the games. Progressive prizes represent another feature which may be offered in gaming systems to increase player interest. Progressive prizes are prizes which are based on wagering activity in the gaming system and thus vary over the course of play. In progressive gaming systems, some fraction of wagers in the gaming system are allocated to one or more progressive prize pools, and these pools are used to pay progressive prizes in response to progressive prize triggering events. One advantage of a progressive gaming system is that the progressive pools may be allowed to grow to very large values and thus provide players with an opportunity to win very large progressive prizes, prizes far in excess of prizes that may be defined in a fixed payout table.

There remains a need in the field of wagering games for systems and arrangements to enhance the player's gaming experience and encourage the player to continue play at a given gaming facility. In particular, there remains a need for progressive gaming systems which maintain player excitement and enhance the gaming experience.

SUMMARY OF THE INVENTION

The present invention encompasses a method of controlling progressive prizes awarded through a group of linked gaming machines. Each gaming machine in the group includes a player input system adapted to receive wagers at the respective gaming machine. In one form, the method includes, for each wager received at a respective gaming machine in the group of gaming machines, incrementing a local progressive meter specific to that respective gaming machine by a first percentage of the wager and incrementing a group progressive meter by a second percentage of the wager. In this step, the local progressive meter is specific to the respective gaming machine at which the wager is received and the group progressive meter is specific to the group of gaming machines so that a wager at a respective gaming machine increments its respective local progressive meter and the group progressive meter, but does not increment the local progressive meter of any other gaming machine in the group of gaming machines. This form of the method also includes incrementing a win meter to maintain a group progressive win count. This step of incrementing the win meter is performed in response to reaching a local trigger value at any of the local progressive meters for the group of gaming machines.

One form of the method takes one of two different courses depending upon whether or not the win meter reaches a group trigger value when it is incremented in response to reaching a local trigger value at any of the local progressive meters for the group of gaming machines. If the win meter does not reach the group trigger value, this form of the method includes awarding a local progressive prize at the respective gaming machine which reached the local trigger value, and decrementing that local progressive meter value by the amount of the local progressive prize. In this step, the local progressive prize comprises an amount from the local progressive meter value for that respective gaming machine. If the group progressive win count reaches the group trigger value, this form of the method includes awarding a group progressive prize at the respective gaming machine which reached the local trigger value and decrementing the group progressive meter value by the amount of the awarded group progressive prize. The group progressive prize in this step comprises an amount from the group progressive meter value. In some forms of the invention, the group progressive prize comprises a value defined as a percentage of the group progressive meter value.

This method of handling progressive prizes facilitates relatively frequent small local progressive prizes at the various gaming machines in the progressive gaming system, and also facilitates relatively less frequent and potentially larger progressive prizes at the various gaming machines in the system. The progressive prizes may not be triggered by any result in a game played at a given player's gaming machine, and thus provides an additional layer of anticipation to game play. The relatively more frequent and small progressive prizes and concurrent potential for relatively large progressive awards operate in concert to help maintain the player's interest in continuing to play games at one of the gaming machines in the system.

Another aspect of the present invention includes a method of controlling the award of a progressive prize in a progressive gaming system. In one form, a method according to this aspect of the invention includes maintaining a progressive pool value at a progressive prize meter in a progressive gaming system. This progressive pool value includes a contribution amount from each progressive contribution qualifying wager placed in the progressive gaming system. The method further includes identifying an award value from a set containing a number of different potential award values, each of which represents at least a portion of the then current progressive meter value. This identifying step is performed with a processing device in the progressive gaming system. In response to a progressive prize triggering event, the method then includes awarding a progressive prize to a player in the progressive gaming system. The value of the progressive prize is equal to the identified award value, and may be dependent on a defined time. This method of controlling the award of a progressive prize has the effect of varying the value of the progressive prize and thereby increasing player interest in the progressive gaming system.

The present invention also encompasses progressive gaming systems for implementing the various methods. One progressive gaming system embodying principles of the invention includes two or more gaming machines, a progressive system processor, and at least one memory device accessible by the progressive system processor. Each gaming machine includes a display device, a player input system, a game processor, and at least one memory device accessible by the game processor and storing instructions executable by the game processor to conduct at least one game at the gaming machine. The memory device or devices accessible by the progressive system processor store instructions executable by the progressive system processor to maintain a progressive pool value at a progressive prize meter. This progressive pool value includes a contribution amount from each progressive contribution qualifying wager placed through one of the gaming machines in the progressive gaming system. The stored instructions are also executable by the progressive system processor to identify an award value from a set containing a number of different potential award values, and, in response to a progressive prize triggering event, award a progressive prize in the amount of the identified award value to a player in the progressive gaming system.

A gaming machine which may be used to implement a progressive gaming system according to one form of the invention includes a game processor and at least one memory device accessible by the game processor which stores instructions executable to conduct at least one game at the gaming machine, including controlling the display device of the gaming machine, and responding to various player inputs through the player input system. In this form of the invention the gaming machine may also include a progressive system processor together with at least one memory device accessible by the progressive system processor and storing instructions for the progressive system processor. These instructions are executable by the progressive system processor in this form of the invention to increment a group progressive pool value based on wagers placed at the gaming machine and others participating in the group progressive pool. Responsive to reaching a local trigger value at a local progressive meter maintained for the gaming machine or a local progressive meter maintained for another one of the participating gaming machines, the instructions also cause the progressive system processor to increment a win meter to maintain a group progressive win count. If the group progressive win count reaches a group trigger value in response to incrementing the win meter, the instructions cause the progressive system processor to award a group progressive prize at the respective gaming machine which reached the local trigger value, and decrement the group progressive meter value by the amount of the awarded group progressive prize. The group progressive prize comprises an amount from the group progressive meter value.

The progressive system processor in some gaming machine embodiments according to the present invention may also execute instructions to maintain a local progressive pool value for that gaming machine and other gaming machines in the progressive gaming system. Otherwise, the local progressive pool values for each gaming machine may be maintained locally at the respective gaming machine.

Because some forms of the invention are implemented using processing devices executing program code, the invention also encompasses program products stored on tangible computer readable media. The program products include program code executable to cause the processing device or devices to perform the steps described above and in the following description of illustrative embodiments.

These and other advantages and features of the invention will be apparent from the following description of illustrative embodiments, considered along with the accompanying drawings.

DESCRIPTION OF ILLUSTRATIVE EMBODIMENTS

In the following description, FIGS. 1-5 will be used to describe gaming machines embodying principles of the invention, and a gaming network in which the gaming machine may be connected. FIG. 6 will be used to describe processes by which progressive games may be controlled according to various embodiments of the present invention, and FIGS. 7-9 will be used to describe certain options within the process shown in FIG. 6.

Figure 1:
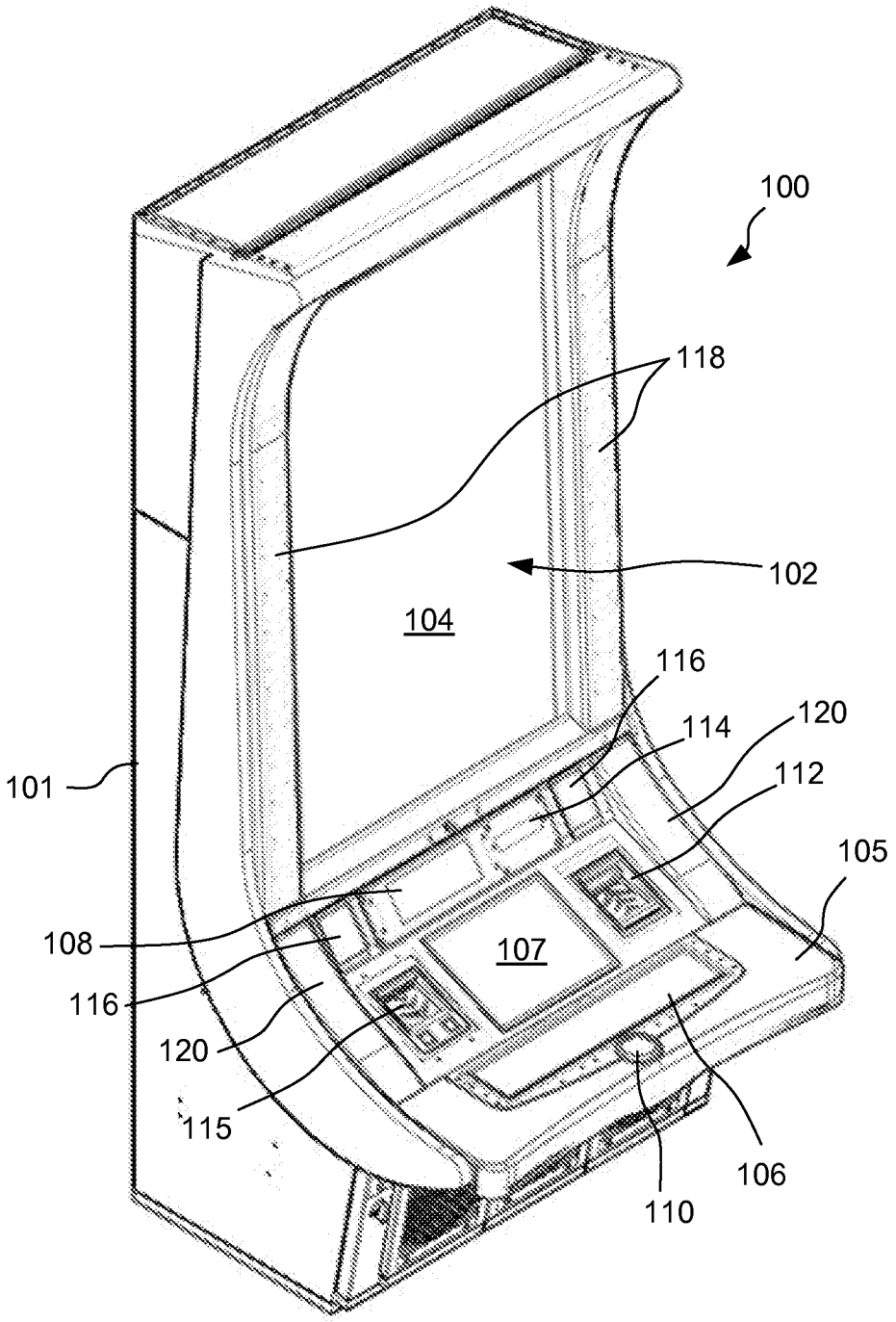
FIG. 1 is an isometric view of a gaming machine which may be used in various embodiments of the present invention.

Referring to FIG. 1, a gaming machine 100 includes a cabinet 101 having a front side generally shown at reference numeral 102. A primary video display device 104 is mounted in a central portion of the front surface 102, with a button panel 106 positioned below the primary video display device and projecting forwardly from the plane of the primary video display device. In this particular implementation, button panel 106 comprises a touch screen display device mounted in an arm rest structure 105. In addition to primary video display device 104, the illustrated gaming machine 100 includes an additional video display device 107 which is also preferably a touch screen display and is positioned in between the primary video display device and button panel 106. The display surface of display device 107 is inclined at an angle to provide a comfortable viewing angle to a player standing or sitting in front of gaming machine 100 with their hands in position to reach button panel 106, display device 107, and perhaps the lower portion of primary display device 104. Gaming machine 100 also includes an additional smaller auxiliary display device 108 located between primary display device 104 and display device 107. Auxiliary display device 108 may also comprise a touch screen device. It should also be noted that each display device referenced herein may include any suitable display device including a cathode ray tube, liquid crystal display, plasma display, LED display, OLED display, or any other type of display device currently known or that may be developed in the future. As will be described further below in connection with FIG. 2 and elsewhere, it is also possible for gaming machines within the scope of the present invention to include mechanical elements such as mechanical reels, a mechanical wheel, or both.

The gaming machine 100 illustrated for purposes of example in FIG. 1 also includes a mechanical control button 110 mounted on arm rest structure 105. Mechanical control button 110 may comprise a "Play" button which may be used to initiate a play in a game at the gaming machine, or may comprise a programmable, multi-function button. It will be appreciated that virtual buttons or other controls to allow a player to select a bet level, select pay lines, select a type of game or game feature, make a progressive participation input, and actually start a play in a primary game may also be implemented on touch screen button panel 106. Other forms of gaming machines through which the invention may be implemented may include switches, joysticks, buttons, or other mechanical input devices, along with the virtual buttons and other controls implemented on touch screen displays such as touch screen button panel 106. For example, the lower areas of primary video display device 104 in gaming machine 100 provides a convenient display device for implementing touch screen controls in addition to or in lieu of mechanical controls or touch screen controls located elsewhere. Mechanical input devices in addition to the single mechanical button 110 may be conveniently located in areas of arm rest 105 not taken up by touch screen devices. The mechanical or touch screen-implemented player interface devices may receive player inputs to initiate a play in a game offered through the gaming machine, or perform other functions, and may be referred to generally as a player input system.

It will be appreciated that gaming machines may also include a number of other player interface devices included in the player input system in addition to devices that are considered player controls for use in playing a particular game or opting in for progressive play. Gaming machine 100 also includes a currency/voucher acceptor 112, a player card reader having a player card input 114, and a voucher/receipt printer 115. Numerous other types of player interface devices may be included in gaming machines that may be used according to the present invention.

A gaming machine which may be used to implement embodiments of the present invention may also include a sound system to provide an audio output to enhance the user's playing experience. For example, illustrated gaming machine 100 includes speakers 116 which may be driven by a suitable audio amplifier (not shown) to provide a desired audio output at the gaming machine. An additional speaker may be included above primary display device 104, but is not shown in the perspective of FIG. 1.

Figure 2:
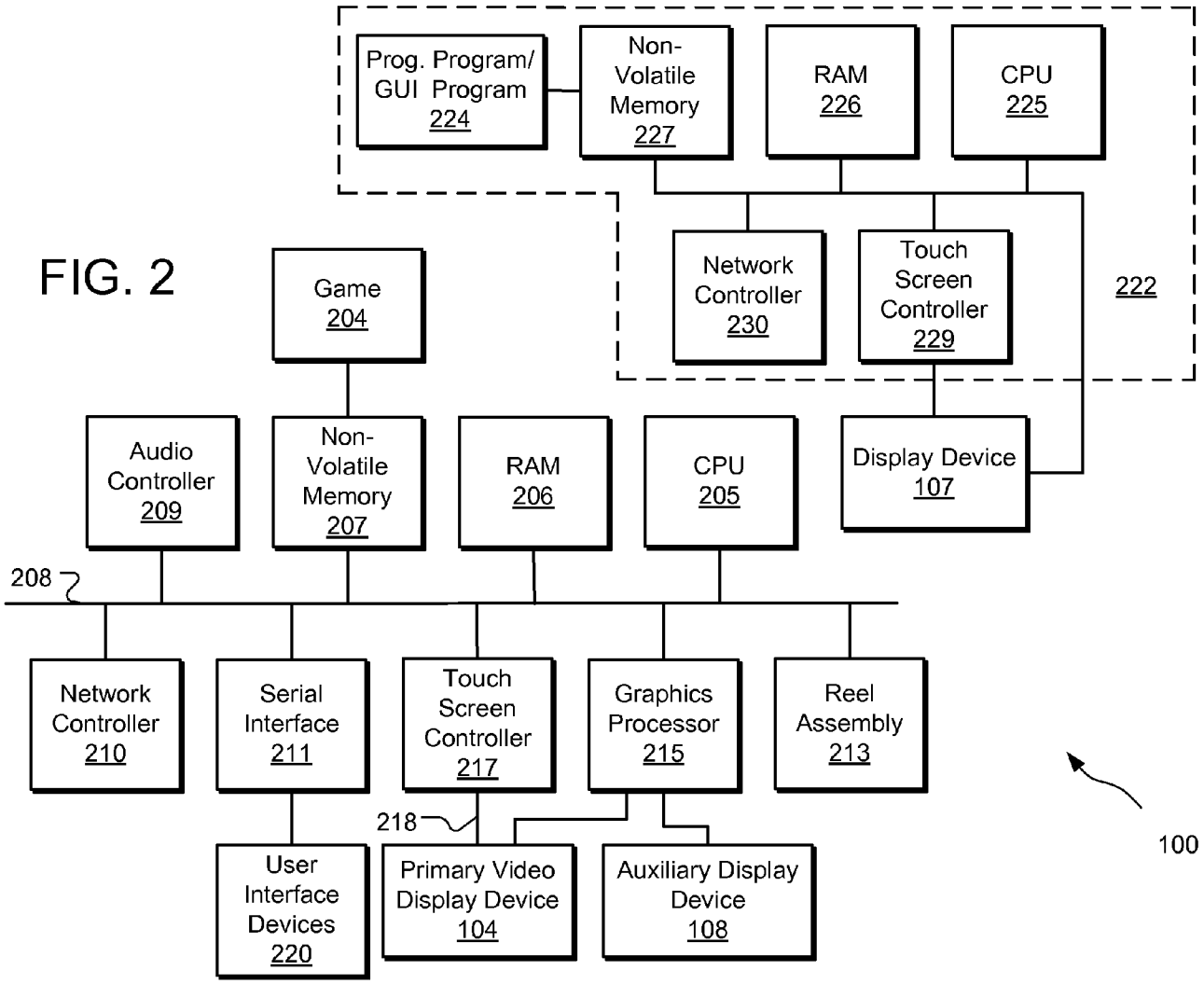
FIG. 2 is a diagrammatic representation showing various components of a gaming machine which may be employed according to one or more embodiments of the present invention.

Although not shown in the drawings, a gaming machine through which forms of the present progressive gaming system may be implemented may also include a video camera located so as to capture video or still images of a player operating the gaming machine. Such a gaming machine camera may be operatively connected to be controlled through CPU 205, or through the separate processing system 222, both of which are shown in FIG. 2 and described further below. Examples of uses of such a video camera in connection with progressive gaming will be described below.

Gaming machine 100 further includes a cabinet accent lighting system for providing accent lighting effects in coordination with events at the gaming machine or otherwise. The illustrated embodiment includes a cabinet accent lighting system having elongated upper accent light fixtures 118 which may include a number of LEDs or other types of lights to provide various lighting effects on either side of primary display device 104. Lower elongated accent light fixtures 120 are also included on either side of the cabinet 101 between the level of primary display device 104 and touch screen button panel 106.

FIG. 2 shows a diagrammatic representation of gaming machine 100 which includes a central processing unit (CPU) 205 along with random access memory (RAM) 206 and non-volatile memory or storage device 207. Nonvolatile storage device 207 stores game program code 204 which is executable by CPU 205. CPU 205, RAM 206, and storage device 207 are all shown connected on a system bus 208 with an audio controller device 209, a network controller 210, and a serial interface 211. A graphics processor 215 is also connected on bus 208 and is connected to drive primary video display device 104 and auxiliary display device 108 (both mounted on cabinet 101 as shown in FIG. 1). As shown in FIG. 2, gaming machine 100 also includes a touch screen controller 217 connected to system bus 208. Touch screen controller 217 is also connected via signal path 218 to receive signals from a touch screen element associated with primary video display device 104. It will be appreciated that the touch screen element may comprise a thin film that is secured over the display surface of primary video display device 104, and/or other video display devices in the gaming machine such as the button panel video display device 106. The touch screen element itself is not illustrated or referenced separately in the figures.

The diagrammatic representation of FIG. 2 also shows gaming machine 100 as including a separate second processing system 222 which may comprise a single board computer. The second processing system 222 is included in the illustrated gaming machine 100 for providing processing functions which may be associated with progressive play as will be discussed further below in connection with FIG. 6. For this reason, processing system 222 may be referred to as a progressive controller. In some progressive gaming systems implementing aspects of the present invention, only a single gaming machine in a bank of gaming machines grouped for progressive play may include second processing system 222 for performing progressive gaming functions. A progressive gaming system along these lines will be discussed below in connection with FIG. 4. Also, alternate implementations of a gaming machine within the scope of the present invention may use game processor 205 to provide processing functions associated with progressive play, or at least some of the progressive play processing functions. Alternatively, progressive gaming functions described below as being performed through processing system 222 may instead be performed through a processing system remote from the gaming machine or any other gaming machine grouped for a given progressive pool. It should also be noted that processing system 222 may provide functions unrelated to progressive gaming in addition to providing progressive gaming functions.

Second processing system 222 includes CPU 225 (which may be referred to as a progressive system processor), with its own random access memory (RAM) 226, and non-volatile memory 227, such as a suitable disk-based or solid state hard drive for storing program code 224 which may be executed by CPU 225. Processing system 222 also includes a network controller 230 and a touch screen controller 229 connected to a suitable touch screen film or other touch-registering element associated with display device 107. Where processing system 222 is dedicated solely for progressive gaming functions the system may omit the control for display device 107 and that device may instead be controlled through game processor CPU 205 or a graphics processor associated with that device.

Those familiar with data processing devices and systems will appreciate that other basic electronic components will be included in gaming machine 100 such as a power supply, cooling systems for the various system components, audio amplifiers, and other devices that are common in gaming machines. These additional devices are omitted from the drawings so as not to obscure the present invention in unnecessary detail.

All of the elements 205, 206, 207, 208, 209, 210, and 211 shown in FIG. 2 are elements commonly associated with a personal computer. These elements may be mounted on a standard personal computer chassis and housed in a standard personal computer housing which is itself mounted in cabinet 101 shown in FIG. 1. Alternatively, the various electronic components may be mounted on one or more circuit boards housed within cabinet 101 without a separate enclosure such as those found in personal computers. Processing system 222 may comprise a single board computer mounted within cabinet 101 or within a separate EMI shielded enclosure within the cabinet.

Those familiar with data processing systems and the various data processing elements shown in FIG. 2 will appreciate that many variations on this illustrated structure may be used within the scope of the present invention. For example, since serial communications are commonly employed to communicate with a touch screen controller such as touch screen controller 217, the touch screen controller may not be connected on system bus 208, but instead include a serial communications line to serial interface 211, which may be a USB controller or a IEEE 1394 controller for example. It will also be appreciated that some of the devices shown in FIG. 2 as being connected directly on system bus 208 may in fact communicate with the other system components through a suitable expansion bus. Audio controller 209, for example, may be connected to the system via a PCI bus. System bus 208 is shown in FIG. 2 merely to indicate that the various components are connected in some fashion for communication with CPU 205 and is not intended to limit the invention to any particular bus architecture. Numerous other variations in the gaming machine internal structure and system may be used without departing from the principles of the present invention.

It will also be appreciated that graphics processors are also commonly a part of modern computer systems. Although separate graphics processor 215 is shown for controlling primary video display device 104, CPU 205 may control all of the display devices directly (or through a graphics processor unit packaged or included with CPU 205) without any intermediate graphics processor. Similarly, although processing system 222 is shown as including no separate graphic processor for controlling display device 107 (thus implying that the graphics processing for display device 107 is handled by CPU 225 or perhaps a graphics processor packaged with CPU 225), implementations of the invention may include a processing system such as system 222 with a separate graphics processor interposed between CPU 225 and display device 107. The invention is not limited to any particular arrangement of processing devices for controlling the video display devices included with gaming machine 100. Also, a gaming machine implementing the present invention is not limited to any particular number of video display devices.

In the illustrated gaming machine 100, CPU 205 executes software (game program code 204) which ultimately controls primary game play and related functions and any secondary or other game play, including the receipt of player inputs and the presentation of the graphic symbols displayed in the course of game play through the display devices 104 and 108 associated with the gaming machine. CPU 205 may thus be referred to as a "game processor." CPU 205 also executes software related to communications handled through network controller 210, and software related to various peripheral devices such as those connected to the system through audio controller 209, serial interface 211, and touch screen controller 217. CPU 205 may also execute software to perform accounting functions associated with play of the primary game. Random access memory 206 provides memory for use by CPU 205 in executing its various software programs while the nonvolatile memory or storage device 207 may comprise a hard drive or other mass storage device providing storage for game software such as game program code 204 prior to loading into random access memory 206 for execution, or for programs not in use or for other data generated or used in the course of gaming machine operation. Network controller 210 provides an interface to separate processing system 222 and other components of a gaming system in which gaming machine 100 may be included. An example overall network will be described below in connection with FIG. 5, and a progressive gaming portion of such a network will be described below in connection with FIG. 4.

In an alternate network configuration within the scope of the present invention a second network controller may be included under the control of CPU 205. This separate network controller may provide an interface to the separate processing system 222 via network controller 230. Such a connection to network controller 230 could be through a crossover cable connected between the separate network controller under the control of CPU 205 and network controller 230 (or perhaps another network controller included in separate processing system 222).

It should be noted that the invention is not limited to gaming machines employing the personal computer-type arrangement of processing devices and interfaces shown in example gaming machine 100. Other gaming machines through which the present progressive gaming systems may be implemented may include one or more special purpose processing devices to perform the various processing steps for implementing the present invention. Unlike general purpose processing devices such as CPU 205, which may comprise an Intel Pentium® or Core® processor for example, these special purpose processing devices may not employ operational program code to direct the various processing steps.

The example gaming machine 100 which may be used to implement some embodiments of the present invention is shown in FIG. 2 as including user interface devices 220 connected to serial interface 211. These user interface devices may include various player input devices such as touch screen button panel 106 in FIG. 1, and/or levers, and other devices. It will be appreciated that the interface between CPU 205 and other player input devices such as player card readers, voucher readers or printers, and other devices may be in the form of serial communications. Thus user serial interface 211 may be used for those additional devices as well, or the gaming machine may include one or more additional serial interface controllers. However, the interface between peripheral devices in the gaming machine, such as player input devices, is not limited to any particular type or standard for purposes of the present invention.

Reel Assembly 213 is shown in the diagrammatic representation of FIG. 2 to illustrate that a gaming machine which may be used for various embodiments of the invention may include mechanical reels or some other mechanical rotating device. For example, a set of mechanical reels may replace the primary display device 104, or at least part of that display device. Alternatively, mechanical reels may be included in the gaming machine behind a light-transmissive video display panel. As will be described below in connection with FIG. 8, embodiments of the present invention may also include a mechanical rotating wheel in connection with displaying a progressive prize amount. Although the invention is not limited to any particular mechanical reel or wheel arrangement or control system, mechanical rotating devices such as reels or wheels may be controlled conveniently through serial communications which provide instructions for a respective stepper motor for each rotating device. Thus some embodiments of the present invention which employ mechanical rotating devices may use a serial interface device such as serial interface controller 211 to control communications with the reel and/or wheel assembly, and may not include a dedicated interface as indicated by FIG. 2. Details of mechanical rotating device arrangements are not shown in the present figures so as to avoid obscuring the present invention in unnecessary detail.

It will be appreciated that the diagrammatic representation shown in FIG. 2 is shown only to provide an example of how gaming machine 100 may be configured for use in a progressive gaming system according to the present invention. Numerous variations on this generalized configuration are possible within the scope of the present invention. As noted above, display device 107 may be controlled through processor 205 (directly or through another graphics processor communicating with processor 205) rather than through the separate processing system 222. Furthermore, one or more of the display devices, such as display device 107 may be controlled through yet another processing system included at the gaming machine (in addition to system 222 and the system controlled by CPU 205) or controlled via a remote processing system.

Figure 3:
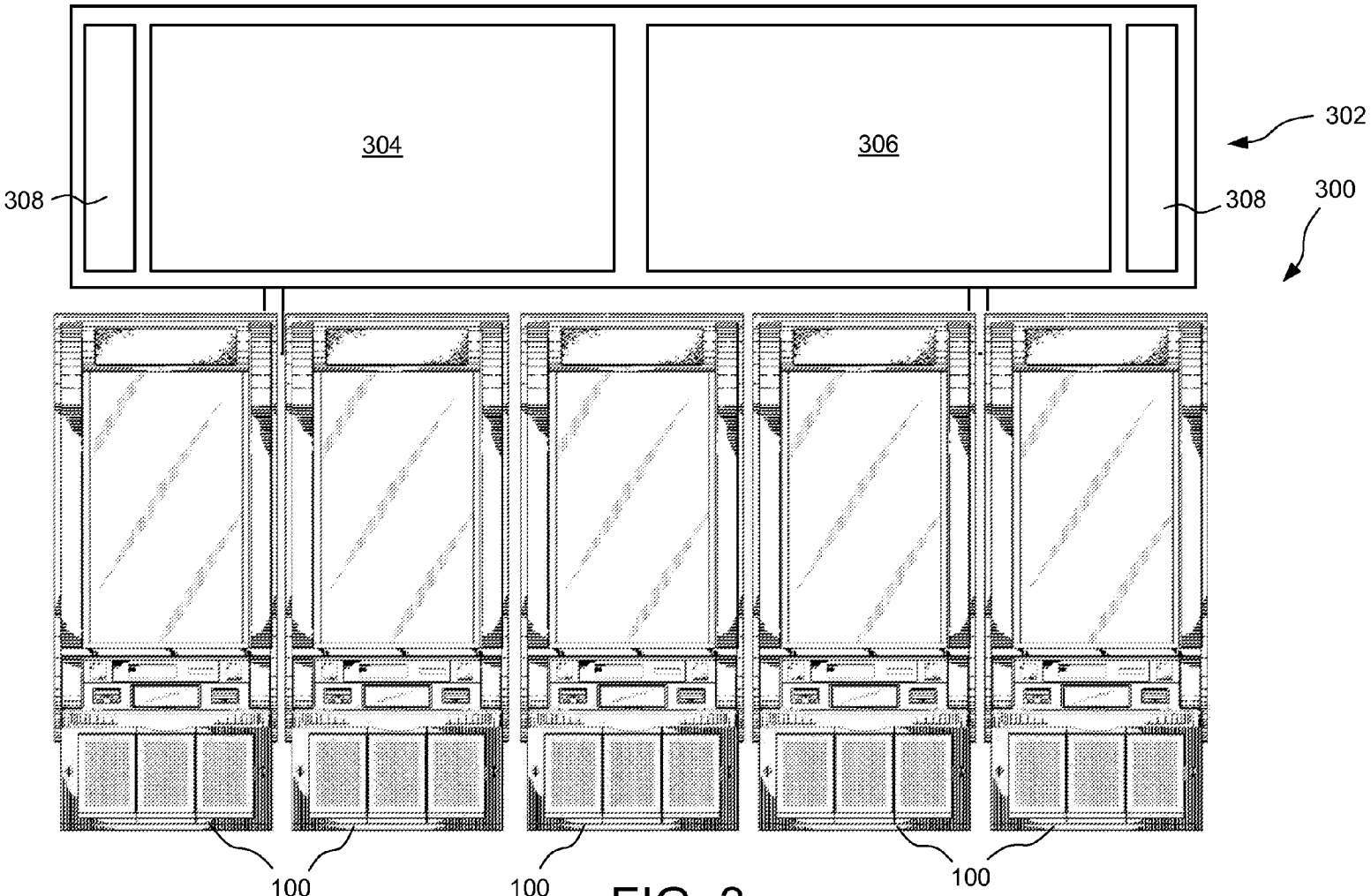
FIG. 3 is a somewhat diagrammatic representation of a bank of gaming machines which may be connected together for providing progressive game play according to various embodiments of the present invention.

FIG. 3 shows a bank 300 of gaming machines 100 together with a group display arrangement 302 shown supported above the gaming machines. The particular group display arrangement 302 shown for purposes of example in FIG. 3 includes two separate video display devices 304 and 306 along with audio speakers 308. It will be appreciated that an additional row of gaming machines 100 may be arranged in bank 300 back-to-back with the row of gaming machines shown in the figure. In such an arrangement of two rows of gaming machines 100, the group display arrangement may include an additional set of display devices and audio speakers (not shown in FIG. 3) facing in the opposite direction from the direction in which the illustrated display devices 304 and 306 and speakers 308 face.

Display devices 304 and 306 associated with group display arrangement 302 may be used for progressive play functions and for functions unrelated to progressive play. For example, one or both of display devices 304 and 306 may be used to periodically or continuously display a group progressive meter value for group progressive prizes which may be available according to the invention. Where there are multiple group progressive pools, this may include displaying more than one group progressive meter value, one for each separate pool. Group video display devices 304 and 306 may also be used to provide various announcements or interesting graphic effects associated with the play of games at gaming machines 100. An example of such a use includes displaying an announcement when a particular level of prize (including a progressive prize) has been won at one of the gaming machines 100 in bank 300 or at a gaming machine elsewhere in the gaming facility. Where gaming machines 100 include a video camera for capturing video or other images of a player at the gaming machine, group display devices 304 and 306 may be used to display the images captured from one or more of these gaming machine video cameras. For example, video of a player who has just been awarded a progressive prize according to the invention may be displayed through group display devices 304 and/or 306. Group display devices 304 and 306 may also be used to display competitive play ranking in the course of competitive play, or final results of competitive play at two or more gaming machines 100 in bank 300 or at other gaming machines in the gaming facility.

Figure 4:
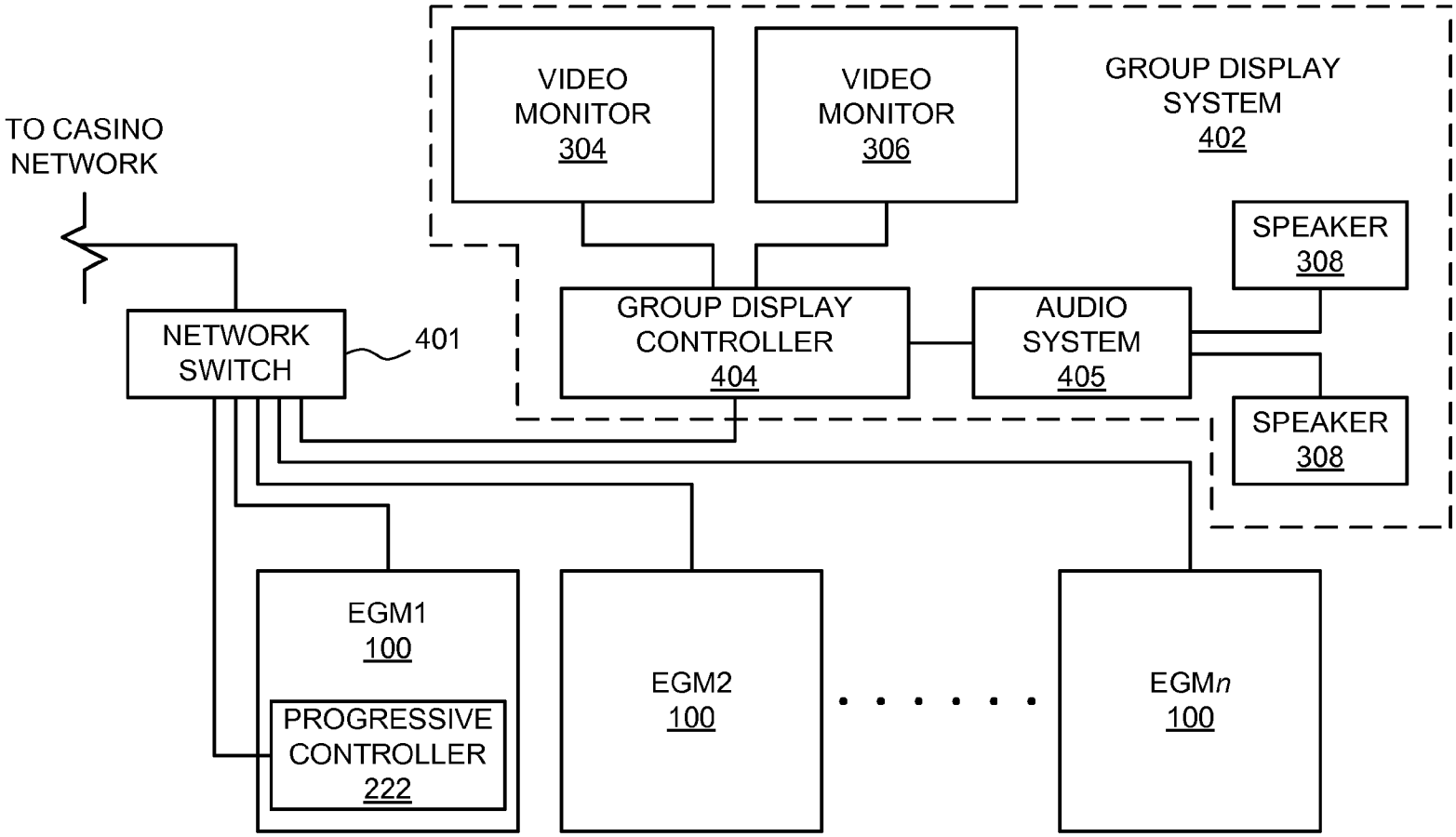
FIG. 4 is a high level diagrammatic representation showing the communications connections between components of a progressive gaming system which may embody forms of the present invention.

FIG. 4 shows a diagrammatic representation of gaming machine bank 300. In particular, FIG. 4 shows each gaming machine 100 connected through a network switch 401 to a gaming facility network and to a group display system 402 via a group display controller 404. Group display system 402 includes group display controller 404, video display devices 304 and 306 and perhaps additional video display devices as described above, and an audio system 405 operable to drive speakers 308.

It should be appreciated that the network topography shown in FIG. 4 is shown only for purposes of example and is not intended to limit the present invention to any particular network topography or network communication standard. Any network or communications arrangement between the various devices in the gaming system may be used to provide the communications described below particularly in connection with FIG. 6.

It will also be noticed that the arrangement shown in FIG. 4 includes a single gaming machine 100 (labeled EGM1) configured with a progressive controller 222. In this arrangement progressive controller 222 associated with gaming machine 100 performs functions associated with at least group aspects of progressive gaming. The other gaming machines in the group (EGM2-EGMn) do not necessarily include a separate processing system 222 serving as a progressive controller, although they may include the separate processing system 222 shown in FIG. 2 for providing other gaming or non-gaming functions, such as controlling display device 107, for example.

Group display controller 404 may include one or more data processing systems with one or more processors, associated memory devices, a network controller to facilitate the indicated network connection, and appropriate interfaces to video display devices 304 and 306 and audio system 405. Group display controller 404 may operate under the control of program code to control video display devices 304 and 306 and audio system 405. Alternatively, group display controller 404 may comprise a special purpose processing device which does not require the execution of software to provide the required functions. Other progressive gaming systems within the scope of the present invention may include no separate group display controller such as controller 404. In these implementations, the video display devices 304 and 306 and audio system 405 may be controlled through progressive controller 222. In these implementations, progressive controller 222 may have a separate communication link to each video display device and to the audio system, and may not employ network communications to these devices through the LAN indicated in FIG. 4.

Figure 5:
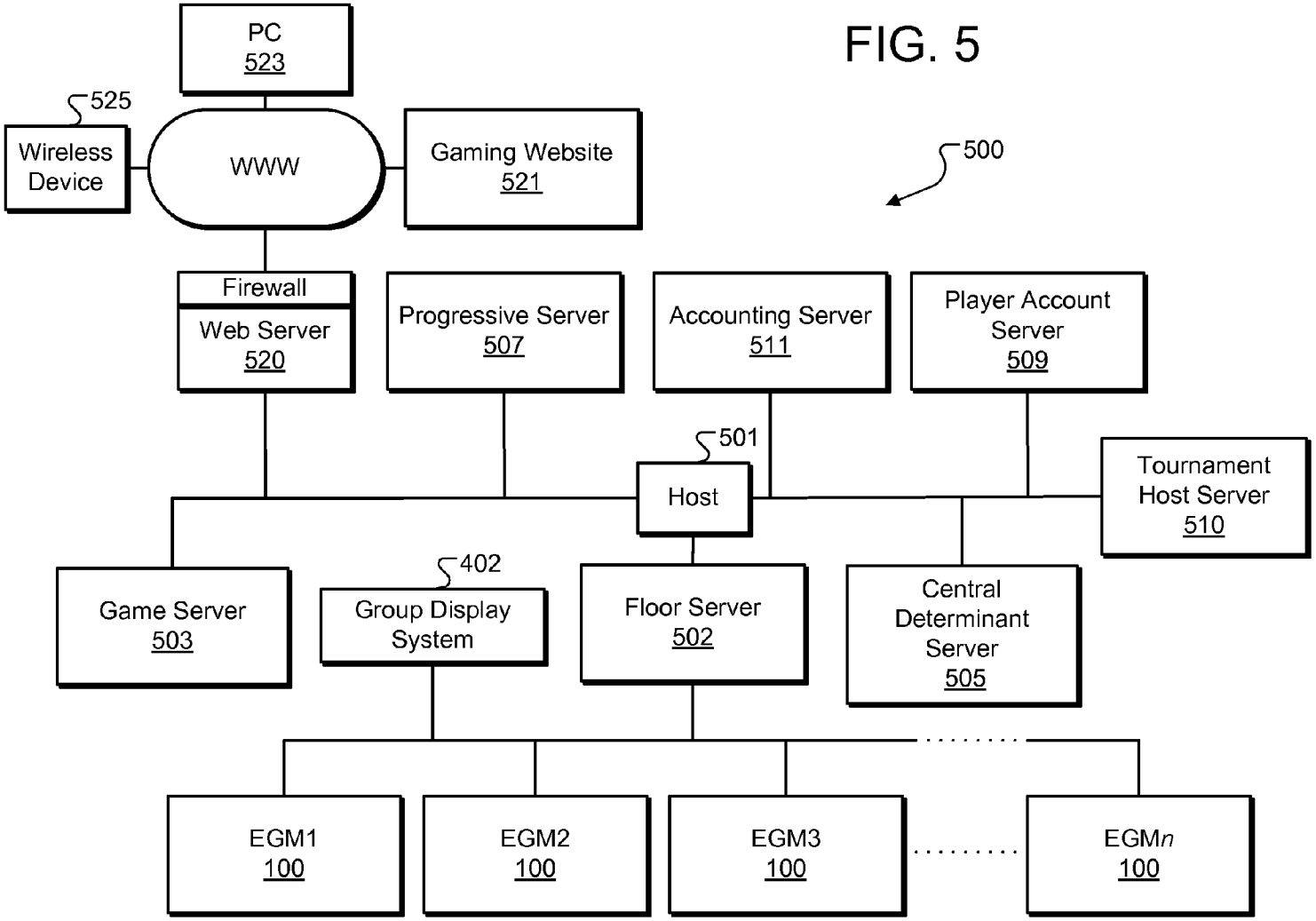
FIG. 5 is a diagrammatic representation of a networked gaming system in which the present invention may be implemented.
Figure 6:
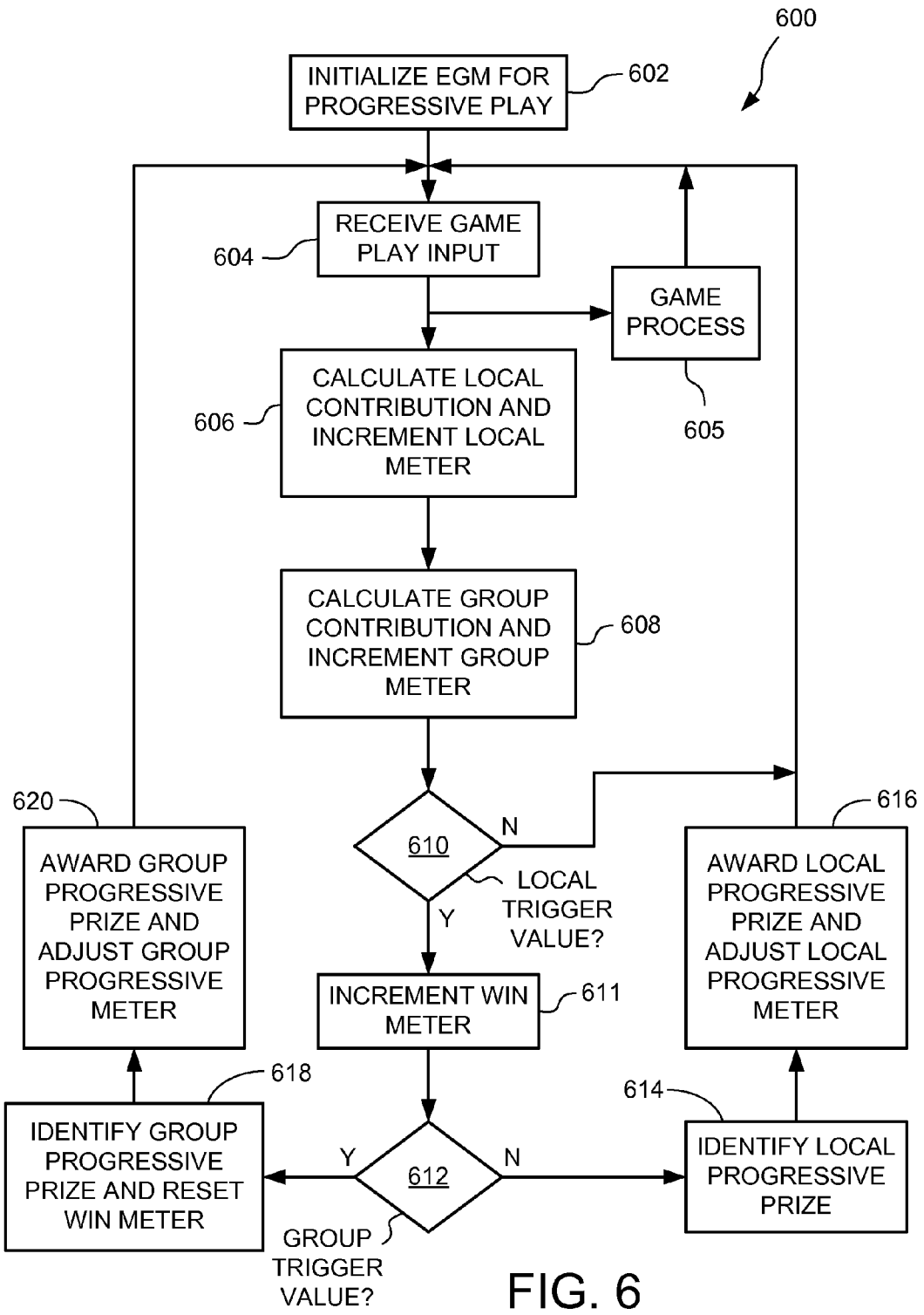
FIG. 6 is a flow chart illustrating processes which may be performed to award progressive prizes according to various embodiments of the present invention.

Referring now to FIG. 5, a networked gaming system 500 associated with one or more gaming facilities may include one or more networked gaming machines 100 (EGMs) connected in the network by suitable network cable or wirelessly. The example gaming network 500 shown in FIG. 5 includes a host server 501 and floor server 502, which together may function as an intermediary between floor devices such as gaming machines 100 and back office devices such as the various servers described below. Game server 503 may provide server-based games and/or game services to network connected gaming devices such as gaming machines 100. Central determinant server 505 may be included in the network to identify or select lottery, bingo, or other centrally determined game outcomes and provide the information to networked gaming machines 100 providing lottery and bingo-based wagering games to players. Although not shown in FIG. 5, a gaming system having gaming machines 100 may also include a player club server. Such a player club server may be connected in the back office network together with progressive server 507, accounting server 511, player account server 509, tournament host server 510, and web server 520. The player club server may function to receive player club communications from the gaming machines 100 to maintain a player club account for each player enrolled in a player club. Alternatively, player club points and other information may be maintained through accounting server 511.

Tournament host server 510 is included in network 500 for supporting the tournament-related processes which may be offered at gaming machines 100. Tournament qualification and tournament game scoring processes may be performed through tournament host server 510 for example. In particular, tournament host server 510 may receive primary game play and wagering information and entry fee payment information from each gaming machine 100 in order to perform tournament qualification functions. Tournament host server 510 may also receive tournament play information from the various gaming machines 100 participating in a tournament, including a point total for the respective gaming machine. In one tournament implementation, each time a tournament score or point-affecting event occurs at a gaming machine 100, the gaming machine communicates an updated score to tournament host server 510. Once every set period of time (every three seconds for example), tournament host server 510 may determine a current point total for gaming machine 100 participating in the current tournament, rank the point totals to produce a ranking for at least some top number of tournament participants (top five or top ten for example), and then communicate that current ranking to the various participating gaming machines along with the point total for each rank position. Tournament host server 510 may also communicate ranking information and point information to a controller for a group display system 402.

Progressive server 507 may be included in gaming system 500 to facilitate casino-wide progressive games and wide-area progressive games, that is, progressive games in which gaming machines over a large geographic area may participate. These casino-wide and wide-area progressive games are to be distinguished from the progressive play described below in connection with FIG. 6 which may not require a progressive server such as server 507. Gaming machines 100 within the scope of the present invention may participate in progressive play as described in FIG. 6 and/or play in casino-wide and wide-area progressive games administered through progressive server 507 and/or other similar servers associated with remote gaming facilities.

Accounting server 511 may receive gaming data from each of the networked gaming devices, perform audit functions, and provide data for gaming analysis programs. Player account server 509 may maintain player account records, and store persistent player data such as accumulated player points in a player club system and/or player preferences (for example, game personalizing selections or options).

Networked gaming machines 100 (EGM1-EGMn) and one or more displays (such as group display devices 304 or 306 in FIG. 3) may be operatively connected so that the group display devices may mirror or replay the content of one or more displays of gaming machines 100. For example, the primary display content for a given gaming machine 100 may be stored by a display controller or game processor 205 or by some other processor of the given gaming machine and transmitted through network controller 210 as shown in FIG. 2 to a controller (such as controller 404 in FIG. 4) associated with the display devices (such as display devices 304 and 306) included in group display system 402. In the event gaming machines 100 have cameras installed, the respective player's video images may be displayed on displays controlled by group display devices along with the content of the player's gaming machine display.

Example gaming network 500 also includes a gaming website 521 which may be hosted through web server 520 and may be accessible by players via the Internet. One or more games may be displayed as described herein and played by a player through a personal computer 523 or handheld wireless device 525 (for example, a Blackberry® cell phone, Apple® iPhone®, personal digital assistant (PDA), iPad®, etc.). To enter website 521, a player may log in with a user name that may, for example, be associated with the player's account information stored on player account server 509. Once logged onto website 521 the player may play various games on the website. Also, website 521 may allow the player to make various personalizing selections and save the information so it is available for use during the player's next gaming session at a casino establishment having the gaming machines 100.

It will be appreciated that gaming network 500 illustrated in FIG. 5 is provided merely as an example of a gaming network in which progressive gaming may be offered according to embodiments of the present invention, and is not intended to be limiting in any way. In particular, servers shown separately in the example of FIG. 5 may be combined in a single physical processing device, or the processing duties of the various illustrated servers may be split into additional physical devices. It will be appreciated that each of the servers shown for example in FIG. 5 may comprise one or more data processing devices with one or more central processing units, associated memory, and related devices.

FIG. 6 may be used to describe various progressive game processes within the scope of the present invention. The process 600 shown in FIG. 6 includes first initializing the gaming machine (EGM) for progressive play as shown at process block 602. Once the gaming machine is initialized for progressive play, the illustrated process includes receiving a game play input as shown at process block 604. From this point, the process separates into two separate process paths. One process path includes game processes as indicated at process block 605. The second process path includes progressive gaming related steps beginning with process block 606. The game processes indicated at process block 605 include identifying a result for the game play input and any prize associated with that result. These game processes may be controlled ultimately through a game processor at the gaming machine such as CPU 205 shown in FIG. 2. The progressive game processes in the second path from process block 604 involve maintaining one or more progressive pools and identifying and awarding progressive prizes from these pools. The progressive game processes may be controlled through a game processor such as CPU 205 in FIG. 2, or a separate processor such as CPU 225 in FIG. 2, or through some combination of these two or other processors. It will be appreciated that the processes shown in FIG. 6 are conducted for each gaming machine that allows progressive play. It should also be appreciated that the steps beginning at receiving the game play input at process block 604 may be conducted for each game play input received at the given gaming machine.

The game play input received at process block 604 will define a wager entered for the given game play at the respective gaming machine. This wager value may be used at process block 606 to calculate a local progressive pool contribution and increment the local progressive meter, and may also be used to calculate a group progressive pool contribution and increment a group progressive meter as indicated at process block 608. After these steps of maintaining the progressive pools based on the received game play input and the associated wager value, the illustrated process includes determining if a local progressive trigger value has been reached as indicated at decision box 610. If this local trigger value has not been reached, the process loops back to receive the next game play input at process block 604. However, if the local trigger value has been reached as indicated by an affirmative outcome at decision box 610, the process moves on to increment a win meter as indicated at process block 611. The process continues then to determine whether the win meter has reached a group trigger value as indicated at decision box 612. If the group trigger value has not been reached as indicated by a negative outcome at decision box 612, the process proceeds to identify a local progressive prize as indicated at process block 614 and then award the local progressive prize and adjust the local progressive meter as indicated at process block 616. The process then returns from process block 616 to await the next game play input at process block 604. If the group trigger value has been reached as indicated by an affirmative outcome at decision box 612, the process continues to identify a group progressive prize as indicated at process block 618 and then award the group progressive prize and adjust the group progressive meter as indicated at process block 620. The process then returns to await the next game play input at process block 604.

Where it is necessary to initialize a given gaming machine for progressive play as indicated at process block 602, the initialization may include a number of separate steps which place the gaming machine and the system in which it is included in position to perform steps later in the process. For example, when the gaming machine first comes online in a gaming system, it may communicate information such as denomination and wager information to a progressive controller such as progressive controller 222. The progressive controller may then respond to these gaming machine communications once the progressive controller performs the various functions necessary to accommodate incoming game play inputs from that gaming machine. It should be appreciated that in some implementations of the invention, no separate gaming machine initialization process is necessary as indicated at process block 602.

The game play input received as indicated at process block 604 may include a single input or several different inputs, all ultimately representing a request for a result in a game and an amount wagered for that particular result. For example, a player at a given gaming machine may be required to make one or more inputs to select a bet level which defines the wager placed for that particular play. A player may also be required to make other inputs or selections depending upon the game being played. All of these inputs may be entered through a user interface system which may include user interface devices such as those indicated at 220 in FIG. 2, and may be received at least at a game processor for the gaming machine (such as CPU 205 in FIG. 2). The present progressive gaming invention is not limited to any particular type of game play input or sequence of actions or inputs which together represent the game play input received as indicated at process block 220 in FIG. 2.

The processes indicated at process blocks 606 and 608 in FIG. 6 are processes that contribute to maintaining two progressive pools, a local progressive pool that is local to that particular gaming machine, and a group progressive pool that is shared among all of the gaming machines in a bank of gaming machines 100 such as that shown in FIG. 3. The pool maintenance requires calculating a contribution amount for each progressive pool based on the wager defined by the game play input. For example, for a given wager, five percent of the wager may be allocated to a local pool for that gaming machine whereas another five percent may be allocated to the group progressive pool. A suitable meter is used to maintain each pool, both the local pool and the group pool. As used herein a "meter" may include a register, a memory location, a physical meter or any other device or combination of devices which are capable of maintaining a running value for amounts added to and subtracted from a progressive pool to provide a current pool value at a give point in time. Various alternative arrangements for the meters noted at process blocks 606 and 608 will be described further below in connection with process blocks 616 and 620.

The communications required to perform these calculations and to maintain the meters will depend upon what particular component or components in the gaming system perform these steps. In some implementations of the invention, the processes indicated at process block 606 may be performed at the respective gaming machine with a processor such as CPU 205 shown in FIG. 2, whereas the processes indicated at process block 608 may be performed at one of the gaming machines having a separate progressive controller such as progressive controller 222 shown in FIG. 2. Alternatively to providing a progressive controller at one of the gaming machines, the progressive controller may be at some other physical location in the network. In other forms of the invention, each gaming machine in the group may be responsible for maintaining the respective local progressive pool for that gaming machine and may also be responsible for redundantly maintaining the group progressive pool. In yet other forms of the invention, a single progressive controller such as progressive controller 222 shown in FIG. 2, or a progressive controller located remotely from each of the gaming machines may maintain the local progressive pool for each respective gaming machine and the group progressive pool. In cases where some device separate from the game processor for the given gaming machine maintains one of the pools, it is necessary to communicate from the gaming machine to the separate device either the wager amount and the contribution fraction (if the fraction is not already known to the separate device), or the value of the contribution calculated from the given wager. Of course, any progressive pool maintenance at the individual gaming machine based on contributions from only that gaming machine requires no communication of data to the gaming machine because the gaming machine will have wager information and the fraction applied as the contribution.

In some forms of the invention, it is desirable to inform each player of the accumulated pool values both for the local pool for the respective gaming machine and the group progressive pool. The processes shown at process blocks 606 and 608 thus may also include communicating the current progressive meter values as necessary so that these values may be displayed by a suitable display device at the gaming machines. In particular, where any of the progressive pool values are maintained at a separate progressive controller such as progressive controller 222 in FIG. 2, the controller will periodically communicate the respective pool value to each gaming machine in the group. At least the group progressive pool value may also be communicated periodically to a group display controller such as controller 404 in FIG. 4, which may then direct one or both of the display devices 304 and 306 to display the current value of the group progressive pool.

In the form of the invention illustrated in FIG. 6, progressive prizes are awarded based upon the amount of progressive contributions which have been collected according to the local progressive meters maintained for the various gaming machines in the system. The process indicated at decision box 610 comprises a process which evaluates the local meter value after adjusting for the contribution for the given game play input received at process block 604 to determine whether a local progressive trigger value has been reached for that gaming machine. If so, the process continues to determine the particular progressive prize to be awarded to the player operating that gaming machine, and, in the illustrated embodiment, from which pool or pools the progressive prize is to be taken. One preferred process for reaching a decision at decision box 610 will be described below in connection with FIG. 7. Regardless of the particular process used to reach the decision indicated at decision box 610, if the decision is negative then the process simply loops back to receive the next game play input in accordance with process block 604.

The process illustrated in FIG. 6 employs a win meter in the process of identifying whether the progressive prize to be awarded is taken from the group progressive pool value or from the local progressive pool value for that gaming machine. As with the local and group progressive meters described above, the win meter may comprise any suitable device or collection of devices for maintaining a current count. In the case of the win meter, the count is of the total number of local triggers that have occurred since the last prize was awarded from the group progressive pool. In the illustrated arrangement, the win meter is incremented each time a particular gaming machine in the group contributing to the group progressive pool reaches the local trigger value as indicated by an affirmative result at decision box 610.

Because the win meter is affected by events at all of the gaming machines in the group, the win meter is conveniently implemented through the progressive controller for the group such as progressive controller 222 shown in FIG. 2. It is possible, however, to maintain a win meter count at each gaming machine. In the former situation in which the win meter is maintained by a progressive controller, the step indicated at process block 611 in FIG. 6 requires a communication to the progressive controller from the component in the system which determines if the local trigger value is met. For example, if the decision indicated at decision box 610 is made at the respective gaming machine, and the win meter is maintained at a progressive controller (which may be co-located at a gaming machine but having a separate network interface as shown in FIG. 2), then the gaming machine must communicate the outcome at decision box 610 to the progressive controller in order to enable the progressive controller to increment the win meter. On the other hand, if the win meter is maintained at each gaming machine and the decision at decision box 610 is made at the respective gaming machine, each game machine must communicate the result from decision box 610 to each other gaming machine to facilitate incrementing each of the redundant win meters.

Regardless of how the win meter is maintained, the illustrated process 600 employs the value of the win meter to determine whether the progressive prize to be awarded is taken from the local progressive pool maintained by the local progressive meter for that gaming machine, or the group progressive pool maintained by the group progressive meter as indicated by decision box 612. In one form of the invention, a static value is used for the group trigger value in making the decision indicated at decision block 612. For example, a static trigger value of some integer X may be set for the decision indicated at box 612. If after incrementing the win meter as indicated at process block 611, the win meter value equals the integer X then the result at decision box 612 will be affirmative. Otherwise in this static trigger value example, the result will be negative. Other forms of the invention may not use a static group trigger value but may, for example, randomly or pseudo randomly select a group trigger value from a range of potential group trigger values for one or more of the decisions indicated at decision box 612. Also, where the win meter is maintained at progressive controller 222, the evaluation indicated at decision box 612 is conveniently performed at progressive controller 222. Where the group meter is redundantly maintained at each gaming machine, a processing device at the respective gaming machine may perform the evaluation indicated at decision box 612.

The process of identifying the local progressive prize value as indicated at process block 614 in FIG. 6 may comprise a number of different processes within the scope of the present invention. Variations on these processes will be described further below in connection with FIGS. 8 and 9. In some preferred forms of the invention, the step of identifying local progressive prize value is performed by a processing device at the particular gaming machine which received the game play input as indicated at process block 604. This identifying step may be conveniently performed at the gaming machine where the gaming machine is also responsible for maintaining the local meter value. However, if the local progressive meter value is maintained at a separate network resource such as the progressive controller 222 in FIG. 2, the identifying step indicated at process block 614 may be performed at the progressive controller. If the win meter is maintained redundantly at each gaming machine and the prize value identification step indicated that process block 614 is performed at the progressive controller, a communication from one of the gaming machines to the progressive controller may be required to initiate the identifying step. The same options are available with regard to the process of identifying the group progressive prize value as indicated at process block 618. The process at block 618 is illustrated in the Figure as also including resetting the win meter. The reset is performed to facilitate triggering the group progressive prize based on the count of local triggers from the award of the previous group progressive prize.

The awarding steps indicated at process blocks 616 and 620 in FIG. 6 involve transferring value from the progressive meter value for the respective progressive pool to the player who has won the respective progressive prize. This transfer may commonly involve incrementing a credit meter for the player's gaming session at the respective gaming machine or incrementing a player account by the amount of the awarded progressive prize, expressed as either credits or currency. In any event, awarding the progressive prize reduces the value of the progressive pool from which the prize is awarded. Thus process blocks 616 and 620 indicate that the respective progressive meter is adjusted to reduce the meter value. This reduction is in the amount of the awarded progressive prize.

As noted above, the invention is not limited to any particular meter device or other arrangement for maintaining the progressive pool value. The incrementing steps indicated in FIG. 6 may involve incrementing the value of single meter value and the decrementing steps may involve reducing that meter value. Alternative arrangements may maintain two separate meters one of which, a "pay in" meter, maintains a running value of all contributions to the respective progressive pool and a separate "pay out" meter maintains a running total of all prizes which have been awarded from the respective pool. In this case, the current value of the respective pool is determined by subtracting the value of the "pay out" meter from the value of the "pay in" meter and the respective progressive prize meter is made up of both meters.

The process indicated at FIG. 6 separates the game processes indicated at process block 605 from the progressive prize awarding processes beginning at process block 606 in the process flow. Thus the timing and amount of a progressive award according to process 600 may be unrelated to any outcome or event in the game process for the given game play at the given gaming machine. Since the progressive awarding process and game processes are separate in this arrangement, the progressive prize may be awarded at any time during the course of game play. In one preferred arrangement, the progressive awards made in accordance with process blocks 616 and 620 are made after the conclusion of the game process (at process block 605) for the given game play. Other forms of the invention may make the progressive awards at some point during the course of the game process indicated at block 605. That is, the game process at process block 605 may be interrupted to make the progressive awards. Otherwise, the timing of actually awarding the progressive prizes may be integrated in any fashion into the game process indicated at process block 605.

In alternative arrangements, the award of progressive prizes may be dependent in some fashion on one or more events in the game process shown at process block 605. For example, the timing of the award indicated at process block 616 or 620 may be coordinated with some event in the course of the game process that process block 605. In one example, the award is made only when the game process produces a losing result. In other arrangements, the progressive award is made only when the game process reaches a particular winning result. In the case where the progressive orders coordinated with some event in the game process, the prizes identified in accordance with process block 614 or 618 may be held in some fashion so that the award may be made at the appropriate time during the given game process.

Some processes according to the invention may announce to the group of gaming machines in some fashion that a progressive prize has been won, and the amount of the progressive prize. This announcement may be made prior to the time that the winner of the progressive prize is notified that they are the one that has won that progressive prize. Such a delay between announcing the winning of the progressive prize to the group of game machines and notifying the particular winner may result from delaying the award to coordinate with some event in the game process or may be based on some elapsed time or some other parameter. For example, the system may announce that the group progressive prize has been won and then show a countdown timer which counts down to the time that the actual winner is notified. The separation of progressive prize win determination from the game process facilitates arrangements which first announce that a progressive prize has been won and then notify the winning player later.

Figure 7:
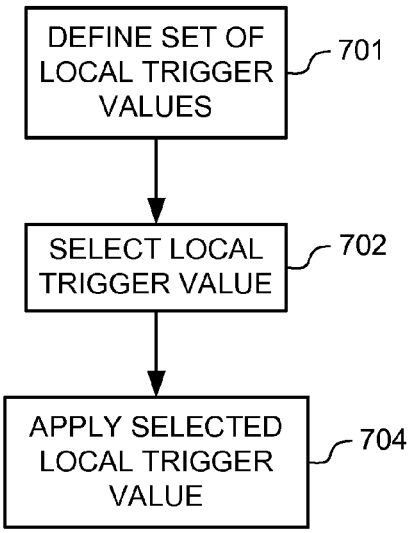
FIG. 7 is a flow chart illustrating processes which may be performed to determine if a progressive prize is to be awarded in various embodiments of the present invention.

FIG. 7 shows one preferred process by which the decision indicated at decision box 610 in FIG. 6 may be made. The process shown in FIG. 7 includes first defining a set of local trigger values as indicated at process block 701. Once the set of local trigger values has been defined, the process includes selecting one of those local trigger values as indicated at process block 702. This selection identifies the trigger value to be applied in making the decision indicated at decision box 610 in FIG. 6. The process in FIG. 7 next includes applying the selected local trigger value in making the local trigger value decision as indicated at process block 704.

In one implementation, a set of potential local trigger values is defined once and this set of potential local trigger values is used multiple times in the process shown in FIG. 7. Alternatively, a different set of potential local trigger values may be defined for each instance of the process shown in FIG. 7. In any case, local trigger values may be defined as any suitable values, including currency values such as $25, $50, $75, and $100 or equivalent credit values. It should be appreciated that the invention is not limited to any particular number of potential trigger values used to define a set or any particular potential trigger values. However, employing low potential trigger values in the set defined as indicated at process block 701 will result in relatively more frequent triggers for a progressive prize, that is, a positive result at decision box 610 in FIG. 6. The potential local trigger values defined according to process block 701 in FIG. 7 need not be evenly distributed across the set. For example, the values may comprise $25, $75, $85, and $100. Although the two examples described above each include four potential trigger values, more or fewer values may be defined for a given set in accordance with process block 701.

The selection indicated at process block 702 in FIG. 7 may be performed in any suitable fashion. One arrangement randomly or pseudo-randomly selects a value from the set of potential trigger values to ensure an even distribution of selections across the potential values over time. The selection may be performed to produce a predefined average trigger value over time as well.

One process for applying the selected local trigger value as indicated at process block 704 in FIG. 7 simply comprises comparing the current value of the respective local progressive prize pool to the selected local trigger value. If the current progressive value is greater than or equal to the selected trigger value, then the decision at process box 610 in FIG. 6 is affirmative, and the process proceeds to eventually award a progressive prize. Any other suitable process may be used to apply the selected local trigger value as indicated at process block 704 in FIG. 7. For example, the application may employ a proximity evaluation. A suitable proximity evaluation might determine if the current progressive pool value is within some proximity value of the selected local trigger value, or is greater than the selected local trigger value. If so, then the outcome at decision box 610 is affirmative and the progressive award is triggered.

In should be appreciated that FIG. 7 shows simply one preferred process for making the determination indicated at decision box 610 in FIG. 6. Any other suitable process may be used.

Figure 8:
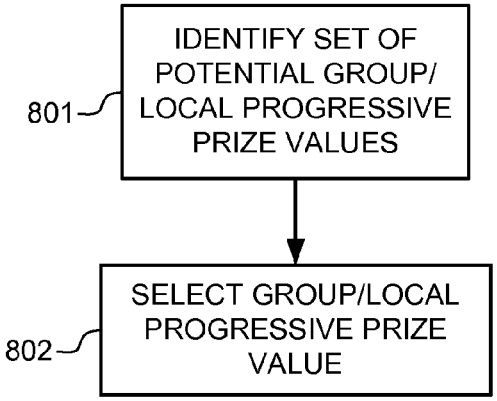
FIG. 8 is a flow chart illustrating a process of identifying a group or local progressive prize value according to some forms of the present invention.

Referring to FIG. 8, the process of identifying the particular progressive prize to be awarded as indicated at either process block 614 or 618 in FIG. 6 may include first identifying a set of potential progressive prize values as indicated at process block 801. The method may then include selecting one of the potential progressive prize values from the set as indicated at process block 802. In one preferred form of the invention, the potential progressive prize values are defined as a percentage of the then current progressive pool value from which the progressive prize is to be awarded. Thus the selection indicated at process block 802 may be from among these percentage values. The selection may be performed in any suitable manner and preferably randomly or pseudo-randomly. The selection process may weight one or more of the potential progressive prize values so that the weighted progressive prize value is selected more or less frequently than the others. Otherwise there may be no weighting or preference between the potential progressive prize values.

Figure 9:
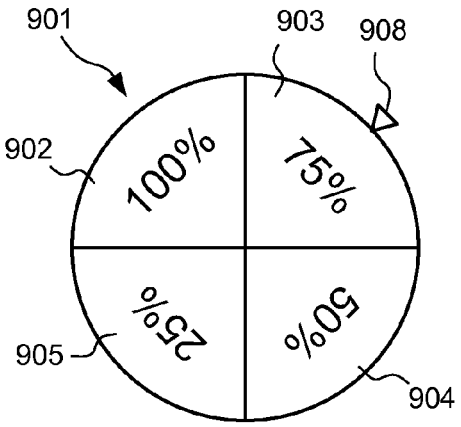
FIG. 9 is a diagrammatic representation of a progressive prize value wheel which may be employed in certain forms of the present invention.

In some preferred forms of the invention, the selection process may be displayed to the player at the respective gaming machine using a device such as the progressive prize wheel 901 shown in FIG. 9. This example prize wheel 901 is divided into quadrants 902, 903, 904, and 905 each associated with a percentage value representing a percentage of the then current value of the progressive pool as indicated by the current meter record. Prize wheel 901 may comprise a virtual device generated on a video display at the given gaming machine (and/or at a group display device such as display device 304 and/or 306 in FIGS. 3 and 4) or may comprise a physical device which physically rotates in response to a spin initiated in some fashion. The prize won for a given spin of wheel 901 may be shown with a quadrant indicator 908 which, once the prize wheel comes to a stop, indicates the quadrant corresponding to the prize to be awarded to the player. In alternate display arrangements, the prize wheel may remain static while an indicator such as indicator 908 travels around the periphery of the prize wheel (physically or through video animation), eventually coming to stop adjacent to one of the quadrants to indicate the progressive prize. In physical prize wheel arrangements, the moving element (the wheel and/or the indicator element) may be driven by a suitable stepper motor under the control of a processor such as CPU 205 shown in FIG. 2 to indicate the prize which has been selected according to the process indicated at process block 802 in FIG. 8. It should be appreciated that the invention is not limited to the prize wheel shown in FIG. 9 or to a set of only four different potential prizes, or to prizes expressed in terms of a percentage of the progressive pool value. Other rotating device arrangements such as spinning reels or rings, or any other device may be used within the scope of the present invention to display the progressive prize amount that has been won according to the invention.

The communications required between the various devices in the system shown for example in FIGS. 3 and 4 are not limited to any particular type or protocol, even though the topography indicated in FIG. 4 is a typical Ethernet network topography. Also, the transport mechanisms may vary between the different devices. For example, in one implementation of the system illustrated in FIG. 4, the transport mechanism for communications between gaming machines 100 and progressive controller 222 may be in the form of Slot Accounting System messages over Ethernet (TCP/IP) using a second Slot Accounting System channel separate from that used for non-progressive game accounting. In this implementation the transport mechanism for communications from progressive controller 222 to group display controller 404 may be G2S protocol over TCP/IP view https, and the discovery transport mechanism in the system (that is, the transport mechanism used for identifying contributing gaming machines in the initialization step shown at block 602 in FIG. 6) may be UDP over Ethernet.

Other variations which may be included in the progressive gaming systems described herein may include variations on adjusting the value of a given progressive pool when a progressive prize is awarded from that pool. In situations in which the progressive prize which is awarded from the given pool represents 100% or some other large percentage of the then current pool value, it is desirable to reset the pool value at some seed value rather than simply reducing the pool value to zero (or some other low value in the case of a large percentage less than 100%) upon awarding the progressive prize. The seed value added to a given pool may vary depending upon the progressive prize which has been awarded. For example, a 25% progressive pool award may reduce the progressive pool to some amount below a minimum pool value, whereas a 50% progressive pool award would reduce the pool value to a greater extent. A seed value needed to raise the pool value to a minimum value will be lower for the 25% pool prize than for the 30% pool prize calculated based on the same pool value.

The present invention also encompasses variations in the way the progressive prizes are identified in process blocks 614 and 618 in FIG. 6. For example, the process described above in connection with FIG. 8 may be used for identifying the group progressive prize as indicated at process block 618, and a different process may be used to identify the local progressive prize as indicated at process block 614, or vice versa.

It should also be appreciated that although the potential progressive prize values identified for the step shown at process block 801 in FIG. 8 may each conveniently be expressed in terms of a percentage of the progressive pool value, the potential progressive prize values may be fixed values or may be expressed in any other way. Fixed prize values may be facilitated by causing the progressive prize to be awarded only when the progressive pool is at or above a predefined value. Thus the win meter step at process block 611 in FIG. 6 and the evaluation at decision box 612 may be replaced with an evaluation of the group progressive pool value to determine if it is at or above a predefined threshold value.

In some implementations of the present invention, whether a given gaming machine in the network is enabled for progressive play may be set by an authorized technician accessing a setup routine at the gaming machine. If the technician enables the gaming machine for progressive play according to the invention, the process conducted at the gaming machine may be as shown in FIG. 6 at process block 602.

Some implementations of the invention may rely on functionality added to existing programs executed at the gaming machine to facilitate the progressive contribution calculation and total progressive value maintenance at the gaming machine. For example, some gaming systems employ program code executed at the game processor of a gaming machine such as CPU 205 in FIG. 2, to load particular game software at the gaming machine. This game loading control software may be modified according to forms of the present invention to add functionality to receive a game payout rate percentage, progressive set aside percentage or value (a fixed or variable value), and to calculate the progressive contribution value as indicated at process blocks 606 and 608 in FIG. 6.

The above discussion related to FIG. 6 generally refers to a single local progressive pool value and a single group progressive pool value. It should be appreciated, however, that the invention is not limited to a single progressive value for either local progressive prizes or group progressive prizes. Rather, progressive games may be implemented according to the invention in which a given wager amount contributes to multiple different local and/or group progressive pools simultaneously, or one of multiple progressive pools depending upon one or more factors, such as the level of the wager for example. In these multiple progressive implementations, the calculations and operations indicated at process blocks 606 and 608 may be performed for each of the different progressive totals being maintained. Also each different progressive pool may have a different trigger as the progressive prize winning event for that pool.

As used in the foregoing description and the following claims, the terms "comprising," "including," "carrying," "having," "containing," "involving," and the like are to be understood to be open-ended, that is, to mean including but not limited to. Any use of ordinal terms such as "first," "second," "third," etc., in the claims to modify a claim element does not by itself connote any priority, precedence, or order of one claim element over another, or the temporal order in which acts of a method are performed. Rather, unless specifically stated otherwise, such ordinal terms are used merely as labels to distinguish one claim element having a certain name from another element having a same name (but for use of the ordinal term).

The above-described example embodiments are intended to illustrate the principles of the invention, but not to limit the scope of the invention. Various other embodiments and modifications to these preferred embodiments may be made by those skilled in the art without departing from the scope of the present invention.

The invention claimed is:

1. A progressive prize method for a group of linked gaming machines, each gaming machine in the group including a player input system adapted to receive wagers at the respective gaming machine, the player input system including a currency/voucher acceptor the method including:

(a) for each qualifying wager received at a respective gaming machine in the group of gaming machines, incrementing a local progressive meter specific to that respective gaming machine by a first percentage of the qualifying wager and incrementing a group progressive meter by a second percentage of the qualifying wager, the local progressive meter being specific to the respective gaming machine at which the qualifying wager is received and the group progressive meter being specific to the group of gaming machines so that a qualifying wager at a respective gaming machine increments its respective local progressive meter and the group progressive meter, but does not increment the local progressive meter of any other gaming machine in the group of gaming machines;

(b) responsive to reaching a local trigger value at any of the local progressive meters for the group of gaming machines, incrementing a win meter to maintain a group progressive win count;

(c) if the win meter does not reach a group trigger value according to the step at element (b), (i) awarding a local progressive prize at the respective gaming machine which reached the local trigger value, (ii) decrementing the local progressive meter by the amount of the local progressive prize, the local progressive prize comprising an amount from the local progressive meter value for that respective gaming machine, and (iii) retaining the group progressive win count of the win meter to be incremented further in accordance with the step at element (b); and (d) if the group progressive win count reaches the group trigger value according to the step at element (b), (i) awarding a group progressive prize at the respective gaming machine which reached the local trigger value, the group progressive prize comprising an amount from the group progressive meter, and (ii) decrementing the group progressive meter by the amount of the awarded group progressive prize.

2. The method of claim 1 further including determining the local trigger value by randomly or pseudo-randomly selecting a value from a set of potential local trigger values.

3. The method of claim 1 further including determining the local trigger value by generating a random or pseudo-random value within a range of potential values.

4. The method of claim 1 further including determining the value of the local progressive prize by randomly or pseudo-randomly selecting a value from a set of potential local progressive prize values.

5. The method of claim 4 wherein the local progressive prize value is a percentage of a current value of the local progressive meter value.

6. The method of claim 1 further including determining the value of the group progressive prize by randomly or pseudo-randomly selecting a value from a set of potential group progressive prize values.

7. The method of claim 6 wherein the group progressive prize value is a percentage of a current value of the group progressive prize meter value.

8. The method of claim 7 further including displaying a prize wheel divided into sectors showing different percentage values, and showing the prize wheel as spinning before coming to rest with an indicator pointed to the sector showing the percentage value representing the group prize value to be awarded according to element (d) of claim 1.

9. A gaming machine including:

(a) a display device;

(b) a player input system including a currency/voucher acceptor;

(c) a game processor;

(d) at least one memory device accessible by the game processor and storing instructions executable by the game processor to conduct at least one game at the gaming machine;

(e) a progressive system processor; and (f) at least one memory device accessible by the progressive system processor and storing instructions executable by the progressive system processor to:

(i) receive a wager value for each qualifying wager entered through the player input system;

(ii) receive a remote wager value for each qualifying wager entered through a player input system of another gaming machine;

(iii) increment a group progressive meter value by a defined fraction of each wager value and each remote wager value;

(iv) responsive to reaching a local trigger value at a local progressive meter maintained for the gaming machine or a local progressive meter maintained for the other gaming machine, increment a win meter to maintain a group progressive win count, the win meter including a value which has been previously incremented responsive to reaching a respective local trigger value at a respective local progressive meter maintained for a different gaming machine;

(v) if the group progressive win count reaches a group trigger value in response to incrementing the win meter, (I) award a group progressive prize at the respective gaming machine which reached the local trigger value, the group progressive prize comprising an amount from the group progressive meter value, and (II) decrement the group progressive meter value by the amount of the awarded group progressive prize.

10. The gaming machine of claim 9 wherein the at least one memory device accessible by the progressive system processor stores instructions executable by the progressive system processor to increment a respective local progressive meter value for the gaming machine by a defined fraction of each wager value, and increment a respective local progressive meter value for the other gaming machine by a respective defined fraction of each remote wager value.

11. The gaming machine of claim 10 wherein the at least one memory device accessible by the progressive system processor stores instructions executable by the progressive system processor to (i) cause the respective local progressive meter value for the gaming machine to be periodically communicated to the game processor, (ii) cause the respective local progressive meter value for the other gaming machine to be periodically communicated to the other gaming machine, and (iii) cause the group progressive meter value to be periodically communicated to the gaming machine and the other gaming machine.

12. The gaming machine of claim 9 wherein the at least one memory device accessible by the progressive system processor stores instructions executable by the progressive system processor to cause the group progressive meter value to be periodically communicated to the gaming machine and the other gaming machine.

13. The gaming machine of claim 9 wherein the at least one memory device accessible by the progressive system processor stores instructions executable by the progressive system processor to select a value for the group progressive prize from a set of potential group progressive prize values.

14. The gaming machine of claim 13 wherein the at least one memory device accessible by the game processor stores instructions executable by the game processor to cause a display device to display a physical or virtual rotating device which indicates the potential group progressive prize values and comes to rest to indicate a value for the group progressive prize.

* * * * *